US005305020A

United States Patent [19]

Gibbons et al.

[11] Patent Number: 5,305,020

[45] Date of Patent: Apr. 19, 1994

[54] THERMAL TRANSFER PRINTER HAVING MEDIA PRE-COAT SELECTION APPARATUS AND METHODS

[75] Inventors: Randel L. Gibbons, Lake Oswego; Lynd L. Wieman, Portland; Suresh C. Paranjpe, Lake Oswego, all of Oreg.

[73] Assignee: Tektronix, Inc., Wilsonville, Oreg.

[21] Appl. No.: 994,383

[22] Filed: Dec. 21, 1992

[51] Int. Cl.[5] ..... B41J 2/325

[52] U.S. Cl. ..... 346/76 PH

[58] Field of Search ..... 346/76 PH; 400/120

[56] References Cited

U.S. PATENT DOCUMENTS 4,704,615 11/1987 Tanaka ..... 346/76 PH

OTHER PUBLICATIONS

"PostScript ® Language Reference Manual," 2nd Edition, 1990, Addison-Wesley Publishing Co., Inc., Reading, Mass., pp. 226-251.

*Primary Examiner*—Benjamin R. Fuller

*Assistant Examiner*—Huan Tran

*Attorney, Agent, or Firm*—John D. Winkelman; Richard B. Preiss

[57] ABSTRACT

A thermal transfer printer (10) includes multiple media trays (16, 120, 126) each encoded to communicate to a printer controller (46) via sensors (132, 134, 136) a print medium size and type contained in the tray, and a pair of thermal transfer ribbon (24) sensors (44,45) to communicate whether the ribbon includes a pre-coat material panel (34). A printer driver responsive to the media size and type sensors and the thermal transfer ribbon sensors to causes pre-coat material to be applied to coated or plain paper print media but not to transparency print media. Post-rendering color correction is provided for color images printed on various media type and pre-coat combinations. The printer driver prevents an image from printing when potentially wasteful conditions are detected in response to a print job request, forced tray selection, or automatic tray switching selection.

16 Claims, 4 Drawing Sheets

THERMAL TRANSFER PRINTER HAVING MEDIA PRE-COAT SELECTION APPARATUS AND METHODS

TECHNICAL FIELD

This invention relates to thermal transfer printing (e.g., thermal wax transfer, dye diffusion transfer, or the like) and more particularly to methods and apparatus for determining whether to apply an image quality and durability improving pre-coat material to a print medium based on various parameters associated with the printer and the print medium.

BACKGROUND OF THE INVENTION

Thermal transfer printing involves the controlled transfer of an ink (e.g., a colorant dispersed in a wax base material) from a carrier such as a polymer ribbon onto a print medium surface. A thermal transfer printer having a print head with a large number of independently activatable heating elements per unit of length is one prior art apparatus employed for this purpose. The ink/carrier structure is placed within the printer such that the carrier side is adjacent to the heating elements and the ink side is adjacent to a print media support upon which the print medium rests during printing.

To print an image, the print head contacts the print medium and ink is transferred to particular locations on the print medium surface when predetermined combinations of heating elements are activated adjacent to those image-forming locations. The ink/carrier structure is locally heated by the heating elements to a temperature at or above the melting point of the ink. In this manner, an amount of ink softens and adheres to the print medium at the predetermined locations to form the image. It is well known that the thermally transferred ink adheres better and more completely to a smooth print medium surface than to a rough surface such as that commonly found in plain paper. Therefore, specially coated paper is typically used in thermal transfer printers to improve the image quality and durability of printed images.

Color images are printed with an ink/carrier structure that includes separate regions of differently colored inks such as the subtractive primary colors, yellow, magenta, and cyan. Color printing is accomplished by sequential passes of the print medium past the print head, each pass selectively transferring different colored inks at predetermined times. Such thermally transferred color images transmit light rectilinearly and are therefore well suited to overhead transparency projection applications. Moreover, transparency film typically has a smooth surface to which thermally transferred ink readily adheres.

Because specially coated print media are relatively costly and not as commonly available as plain paper, some means is desired to improve the durability and image quality of thermal transfer images printed on plain paper. U.S. Pat. No. 4,704,615 of Tanaka for THERMAL TRANSFER PRINTING APPARATUS describes an ink/carrier ribbon having yellow, magenta, and cyan ink panels and an additional panel of pre-coat material (hereafter "pre-coat"). Pre-coat is thermally transferred to predetermined areas of a rough print medium, such as plain paper, that subsequently receive a thermally transferred image. Pre-coat adheres to rough media and provides a smooth, transparent, thermal adhesive base to which thermally transferred inks readily adhere. Alternatively, pre-coat can be white to improve the chroma and brightness of images printed on opaque or colored media.

Pre-coat has disadvantages, however, such as degradation of the light transmission through transparency film, and degradation of image quality, by forming a "halo" around images when applied to coated media. Colors may also be perceived differently when viewed under the various above-described combinations of media type and pre-coating.

Thermal printing ribbons are available with a single black panel, three color panels (yellow, magenta, and cyan), or four color panels, (yellow, magenta, cyan, and black). Such ribbons are typically supplied on spools that have encoded end caps to communicate to the printer whether the ribbon includes one, three, or four panels. All colored ribbons also have an encoding stripe that runs along one edge of the length of the ribbon to communicate panel location and color data to the printer.

Printers have been developed that can print images on various print media types including, but not limited to, plain paper, coated paper, and transparency film. Such print media types are also available in a variety of standard sizes such as letter (A-size) and international A4-size.

Some printers, such as one embodying this invention, clamp an edge of a selected print medium to a drum and wrap the print medium around the drum during printing. Such an arrangement provides accurate control of print medium positioning relative to the print head and is particularly advantageous in applications such as multi-pass color printing. However, because printing can not be accomplished adjacent to the clamped edge of the medium, special extended-length media are available that include a perforated tear-off strip. Such media can be clamped at the extended length portion and printed over a remaining standard length portion. After printing, the extended-length portion is removed at the perforation. Plain paper, coated paper, and transparency film are currently available in A-size and A4-size, with or without a perforated extended-length portion.

Because a wide variety of print media exists, printers have been developed that have multiple media feeders into which a variety of media trays can be fitted. The trays are each sized to hold specific sizes of paper and are encoded to communicate the paper size to the printer. Some trays are also fitted with a switch by which the media type loaded in the tray, such as "transparency" or "paper," can be selected and communicated to the printer.

Most printers can detect when the print medium in a tray has been depleted or the tray is not inserted and take appropriate actions such as halting printing, lighting an "out of paper" indicator, switching trays, and sending an "add paper" or "insert tray" message to the printer user. Because there is such a variety of media types and sizes, a thermal transfer printer capable of automatically determining whether to pre-coat user selected combinations of trays, media types, and media sizes would be advantageous.

Many printers include a control software driver program (hereafter "printer driver") for handling many of the variables described above. Such printer drivers are often interfaced to a computer programming language known as PostScript ®, which is available from Adobe Systems Inc., Mountain View, Cal. The PostScript ® language, described in the PostScript ® Language Reference Manual, Second Edition, 1990, Addison-Wesley Publishing Co., Reading, Mass., includes methods for manipulating text and graphics, selecting media sizes, types, trays, and the number of copies to be printed. These and other variables are collected together with data to be printed into a data file referred to as a print job. PostScript ® also supports multiple print job queuing, sorts print job priorities, and handles errors detected in the print jobs.

Print job errors are ordinarily resolved by PostScript ®. For example, if a requested paper size is depleted PostScript ® may automatically switch (if multi-tray printer) and print on any available media in another tray. The problem is that PostScript ® was developed without a foreknowledge of evolving technologies such as thermal transfer printing. New printing technologies require circumvention by the printer driver of some existing error resolution methods.

For example, in a thermal transfer printer, switching trays when a tray becomes empty does not address whether the alternate tray has coated paper, whether pre-coat ribbon is installed, or whether a tray has extended-length perforated paper (that may be either plain or coated). Moreover, the perceived colors of a thermal transfer image are altered by various combinations of media type and pre-coat. Acceptable image colors printed by one type of printer may not be acceptable colors when printed by a thermal transfer printer with arbitrary combinations of media type and pre-coat. PostScript ® supports a post-rendering lookup table for correcting colors, but no method exists for switching color correction tables in response to media type and pre-coat combinations found in multi-tray thermal transfer Finally, a PostScript ® tray switching printing. Finally, a PostScript ® tray switching capability that allows inadvertent printing on transparency film does not account for the presence of pre-coat or the expense of wasted thermal transfer ribbon and results in an unacceptable and expensive waste of time and materials.

Therefore, what is needed is a method and apparatus for determining whether to pre-coat and print a particular print medium under predetermined combinations of the above-described print medium and printer related variables.

SUMMARY OF THE INVENTION

An object of this invention is, therefore, to provide an apparatus and a method for use with thermal transfer printing technologies to provide the most favorable print conditions notwithstanding ambiguous cases, error conditions, and variable combinations determining whether to pre-coat a particular print medium under a variety of circumstances.

Another object of the present invention is to provide an apparatus and method for providing appropriate color correction as a function of pre-coat and type of print medium.

A further object of the present invention is to provide an apparatus and a method for reducing occurrences of unintentionally printed media and thereby provide more efficient printer operation by reducing the expense of wasted media and thermal transfer ribbons.

Still another object of the present invention is to provide a PostScript ®-compatible printer driver that resolves ambiguous cases, error conditions, and variable combinations consistent with the above-stated objectives.

The methods and apparatus of this invention utilize sensors that detect media type and size and thermal transfer ribbon type. The printer driver is responsive to the sensors and causes pre-coat to be applied to coated or plain paper media but not to transparency type media. Post-rendering color correction is provided in response to different media type and pre-coat combinations. In contrast to prior printers, the printer driver prevents the printing of an image when potentially wasteful conditions are detected in response to a print job request, or an inappropriate media tray selection.

Additional objects and advantages of this invention will be apparent from the following detailed description of a preferred embodiment thereof which proceeds with reference to the accompanying drawings.

DETAILED DESCRIPTION OF PREFERRED EMBODIMENT

Figure 1:
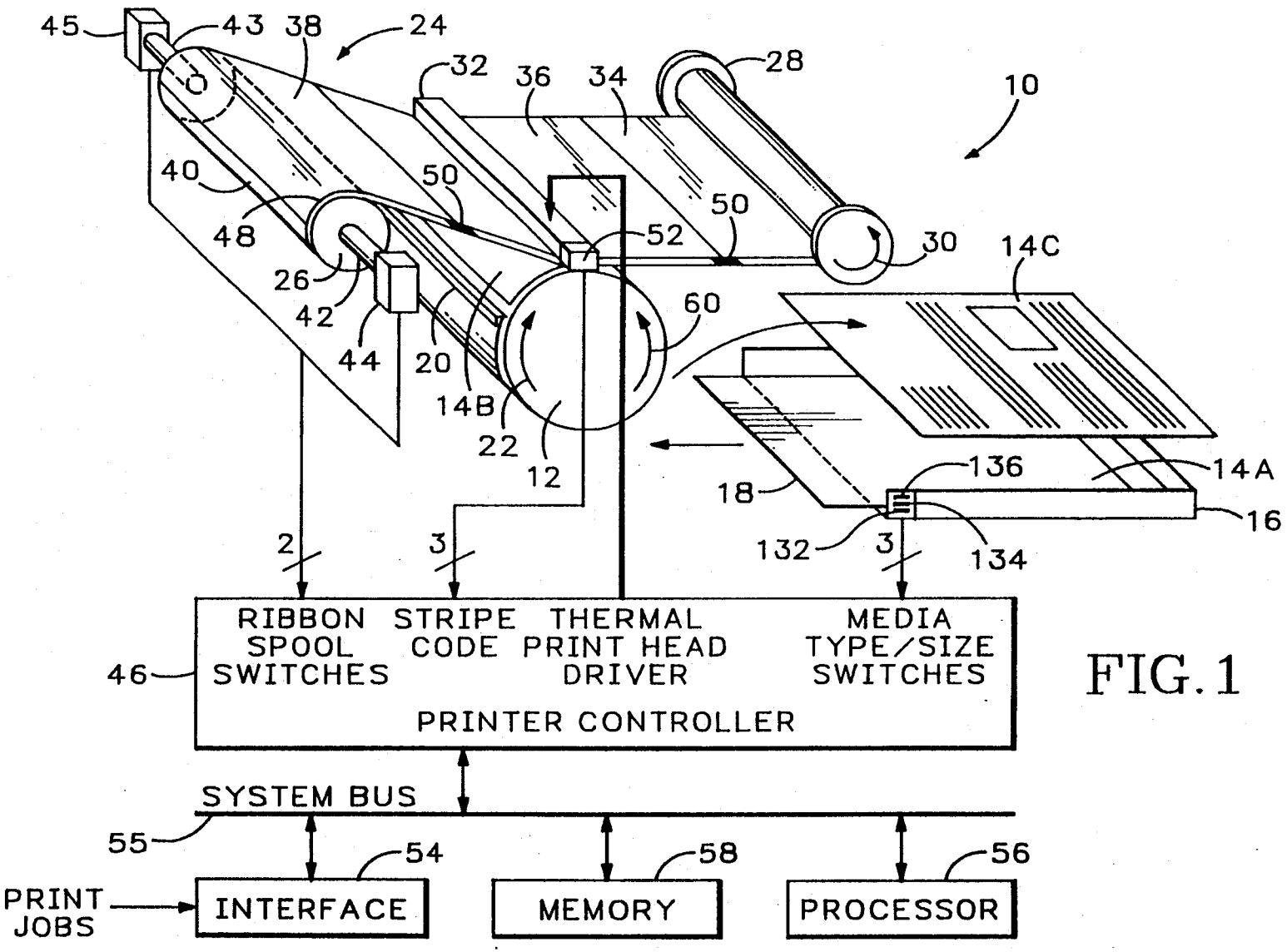
FIG. 1 is a functional schematic diagram showing the interrelationship among the electromechanical components of a thermal transfer printing system according to this invention.

Referring to FIG. 1, a thermal transfer printing system 10 (hereafter "printer 10") is shown that includes a drum 12 upon which a print medium 14A is received from a media tray 16. (Print medium 14 is shown in printer 10 at three locations designated by a letter suffix, i.e., 14A, 14B, or 14C.) A leading edge 18 of print medium 14A is fed by conventional means to a medium clamp 20 which secures print medium 14B to drum 12, which then rotates in a direction indicated by arrow 22 to wrap print medium 14B around drum 12. Drum 12 is preferably of a diameter sufficient to hold extended-length A4-size media and is coated with rubber to enhance media-to-drum dimensional stability and thermal transferability of ink to print medium 14B.

Printer 10 also includes a thermal transfer ribbon 24 suspended between a supply spool 26 and a take-up spool 28. Take-up spool 28 is driven in a direction indicated by arrow 30 with a torque sufficient to feed ribbon 24 through a nip formed between drum 12 and a thermal print head 32 at a rate determined by the rotation of drum 12. Ribbon 24 preferably includes repeating sets of pre-coat 34, yellow 36, magenta 38, and cyan 40 panels. Many commercially available ribbons do not include pre-coat panels 34.

The type of ribbon 24 (black, three, or four panels) is encoded by hub-length into a left hub 42 and a right hub 43 on supply spool 26. Hubs 42 and 43 are each of a normal or extended-length, and selectively activate a left microswitch 44 and/or a right microswitch 45 as listed in Table 1. The states of microswitches 44 and 45 are sensed by a printer controller 46.

TABLE 1

| RIBBON TYPE | LEFT SWITCH | RIGHT SWITCH |
|---|---|---|
| Black | On | On |
| Three panel | Off | Off |
| Four panel | On | Off |

Ribbon 24 also includes an opaque encoding stripe 48 having A coded marker 50 at location indicating the boundaries between panels 34, 36, 38, and 40. Coded marker 50 may, for example, comprise a series of transparent stripes detectable by a photosensor array 52 mounted adjacent to thermal print head 32. The number of stripes in each coded marker 50 indicates to printer controller 46 which of panels 34, 36, 38, or 40 is aligned with thermal print head 32. Preferably, pre-coat panel 34 is indicated by two stripes and color panels 36, 38, and 40 are each indicated by one stripe, with the color panels arranged in a predetermined order.

In operation, printer 10 receives a print job at a data communications interface 54. The print job is transferred to a system bus 55 that is in communication with printer controller 46, a processor 56, and a memory 58. Processor 56 processes data and commands contained in the print job and transmits control and printing data to printer controller 46. Processor 56 executes the printer driver stored in memory 58, and exchanges data with a PostScript ® interpreter.

After the print job is interpreted by processor 56 and stored as yellow, magenta, and cyan image data in memory 58, printer controller 46 causes print medium 14A to feed from media tray 16 to medium clamp 20 on drum 12. Medium clamp 20 is activated and drum 12 is caused to rotate such that leading edge 18 of print medium 14B is just past the nip between drum 12 and thermal print head 32. Ribbon 24 is moved by take-up spool 28 until a coded marker 50 is detected by photosensor array 52 indicating that a pre-coat panel 34 is positioned under thermal print head 32. Drum 12 is rotated one revolution and pre-coat panel 34 is moved through the nip while all the image data stored in memory 58 simultaneously drives thermal print head 32, thereby thermally transferring a pre-coat image to print medium 14B and advancing ribbon 24 such that yellow panel 36 is in the nip. Drum 12 is rotated a second revolution and yellow panel 36 is moved through the nip while the yellow image data stored in memory 58 simultaneously drives thermal print head 32, thereby thermally transferring a yellow image to print medium 14B and advancing ribbon 24 such that magenta panel 38 is in the nip. The sequence is repeated for the magenta and cyan image data until a full color image is transferred and registered on top of the pre-coat image on print medium 14B. Drum 12 reverses and rotates in the direction of an arrow 60, releases medium clamp 20, and feeds print medium 14C from printer 10 by means of a conventional exit path mechanism (not shown).

Figure 2:
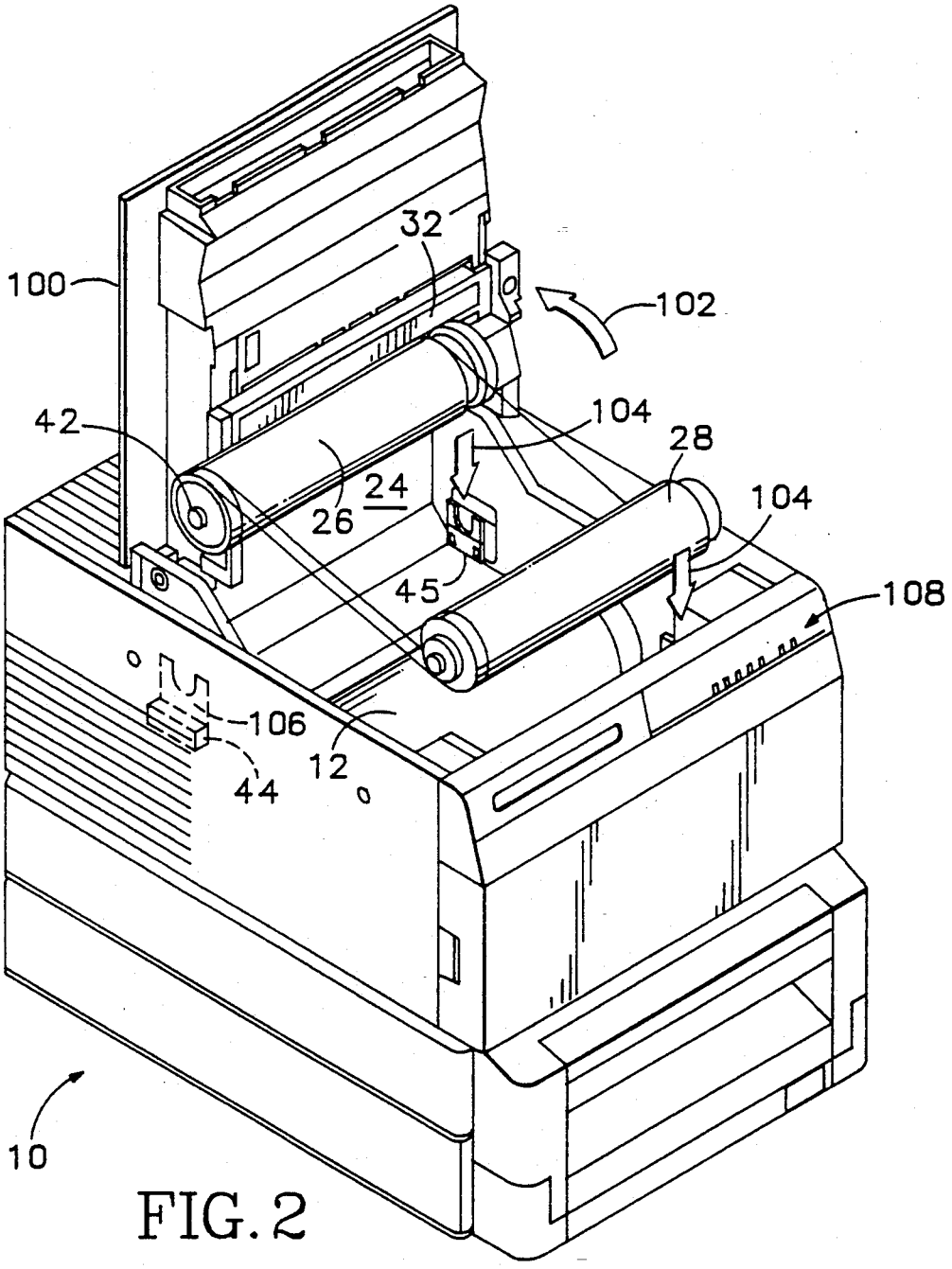
FIG. 2 is an isometric pictorial diagram of a thermal transfer printer according to this invention showing a ribbon access door in an open position to expose major components of the printer.

FIG. 2 shows printer 10 with a ribbon access door 100 shown in an open position indicated by an arrow 102 to expose ribbon 24 in a position removed from printer 10. Ribbon 24 is installed by lowering supply spool 26 and take-up spool 28 into printer 10 in the direction of arrows 104. If ribbon 24 includes pre-coat panel 34, supply spool 26 will have extended-length left hub 42 that activates left hub microswitch 44 (shown in phantom) mounted adjacent to a hub support 106 (shown in phantom). Also shown are drum 12, thermal print head 32, and a set of status indicators (shown generally as indicators 108).

Figure 3A:
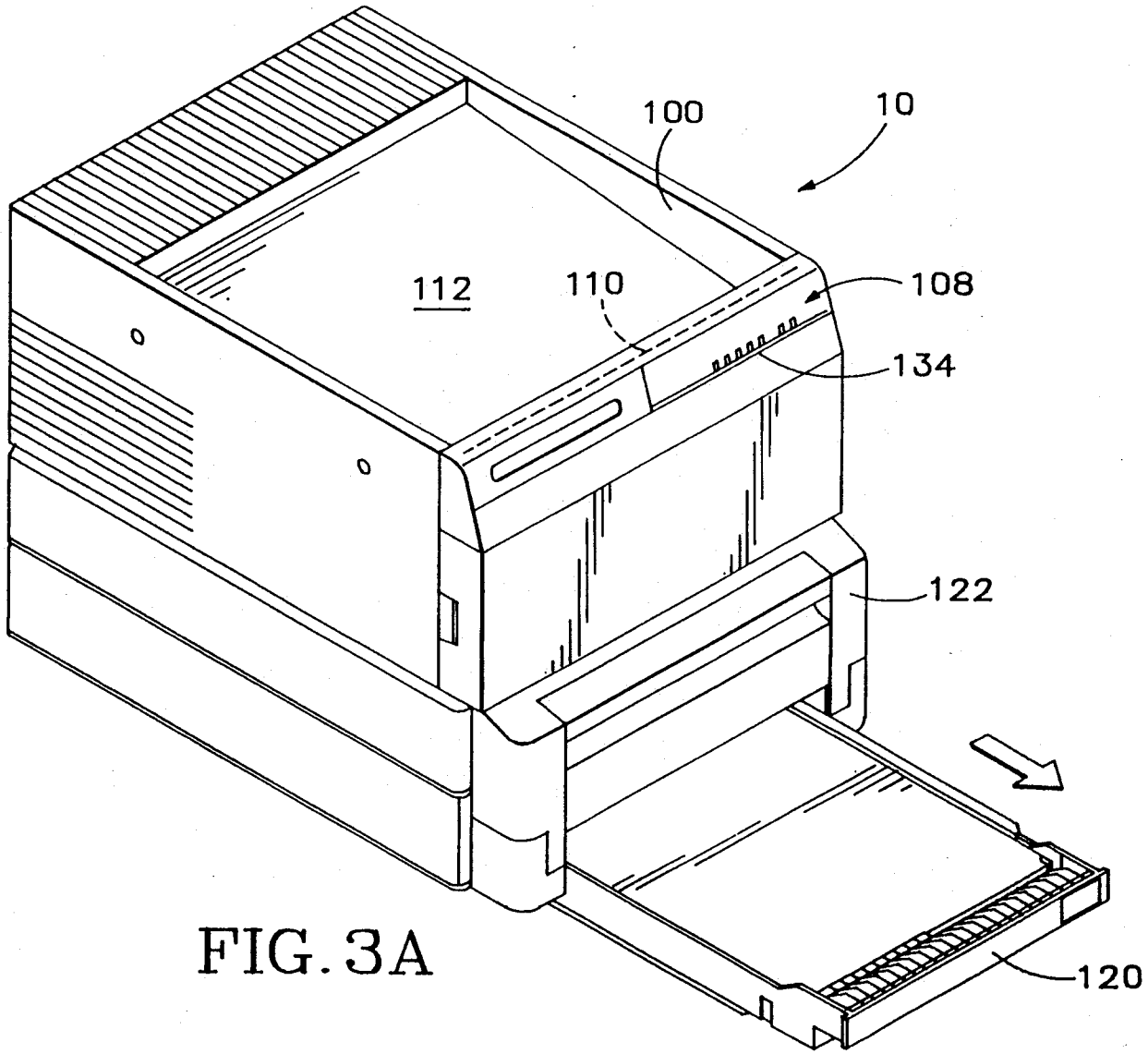
FIG. 3A is an isometric pictorial diagram of a thermal transfer printer according to this invention showing a media tray access door in a closed position and a lower media tray in a partly withdrawn position.

FIG. 3A shows printer 10 with ribbon access door 100 closed exposing a media exit slot 110 (shown in phantom) and a media stacker 112. Also shown are a lower media tray 120 in a partly withdrawn position, and a media tray access door 122 in a closed position.

Figure 3B:
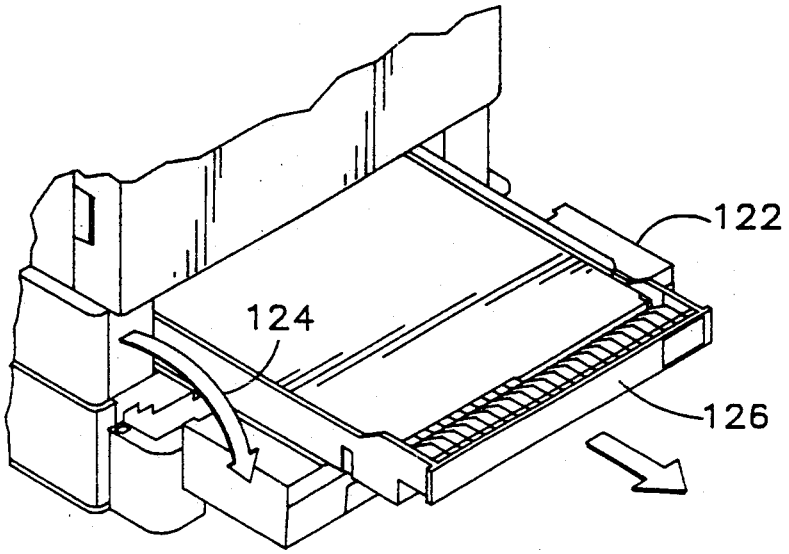
FIG. 3B is a fragmentary isometric pictorial view of the media tray access door of FIG. 3A shown in an open position and with an upper media tray shown in a partly withdrawn position.

FIG. 3B shows media tray access door 122 in an open position as indicated by arrow 124 to expose an upper media tray 126, shown in a partly withdrawn position.

Figure 4:
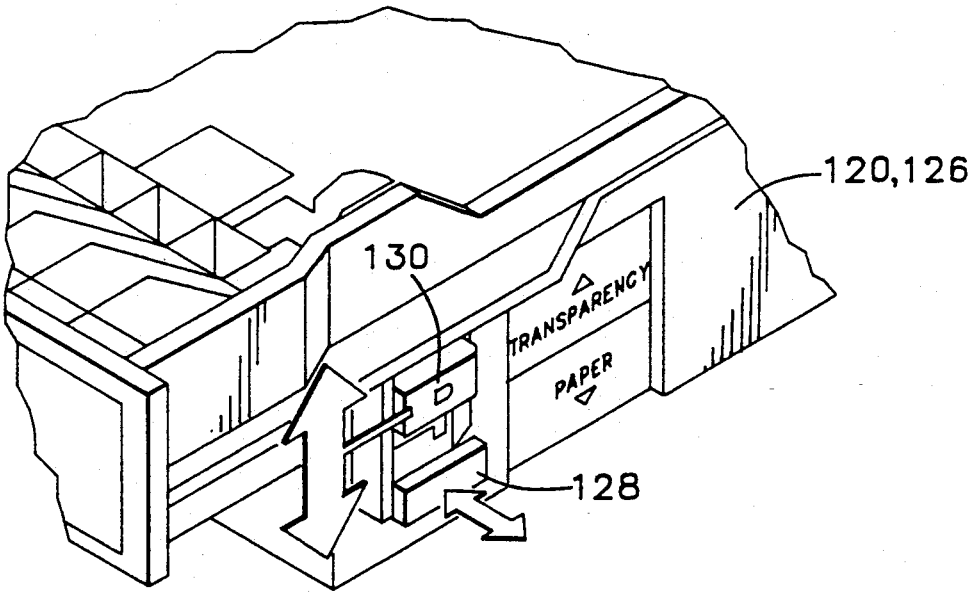
FIG. 4 is an enlarged isometric pictorial view of a portion of a media tray showing a media type selection switch according to this invention.

Referring to FIGS. 1, 3A, and 3B, a variety of interchangeable media trays 16, 120, and 126 are available for holding media of different types and sizes. As shown in more detail in FIG. 4, the size (e.g., A, A4, A perforated, and A4 perforated) and type of media (e.g., paper or transparency film) contained in the media tray is encoded by a removable A4-size media tab 128, a slidable media type selection switch 130 settable to indicate that the media tray is loaded with either paper or transparency media, and a second removable tab 131 (not shown) that is inserted into an unselected position of media type selection switch 130 on trays designed to hold non-perforated A-size or A4-size media. Removable tabs 128 and 131 and the position of media type selection switch 130 are communicated to printer controller 46 by three microswitches 132, 134, and 136 (FIG. 1) that sense respectively the presence of A4-size media tab 128 and the "paper" and "transparency" positions of media type selection switch 130 as set forth below in Table 2.

TABLE 2

| MEDIA SIZE | TRANS | PAPER | A4 TAB |
|---|---|---|---|
| A | R | R | |
| A4 | R | R | R |
| A-Perf Paper | U | | |
| A-Perf Trans | | U | |
| A4-Perf Paper | U | | R |
| A4-Perf Trans | | U | R |

U = user setting of selection switch 130
R = presence of removable tabs 128 and 131

Of course, a similar set of microswitches exists for each media tray in the printer, and the set of microswitches currently sensed is determined by the currently selected media tray.

Printer 10 also conventionally detects whether lower media tray 120 or upper media tray 126 is empty, communicates lower and/or upper media tray empty status (whichever media tray is currently selected) to printer controller 46, and accordingly activates a "media" indicator 134 (FIG. 3A).

Ribbon type sensing microswitches 44 and 45, media size encoding tabs 128 and 131, media type selection switch 130, media tray empty status, and media tray selection (lower 120 or upper 126) together provide data to printer controller 46 and processor 56 useful for resolving ambiguous cases and error conditions when determining whether to pre-coat a particular size and type of print medium 14 in response to a particular print job.

A more complete description of processor 56 interaction with printer controller 46 follows with reference to FIG. 1. The PostScript ® interpreter includes an interface to the printer driver which in turn includes calls that execute PostScript ® "operators," "dictionaries,"

and "policies" in processor 56 in response to requests and data in a print job. PostScript® executable print jobs include a "setpagedevice" operator that requests some combination of media type, media size, media weight, media color, number of copies, and image size for the print job. PostScript® responds by configuring a "currentpagedevice" operator.

PostScript® dictionaries include stored values representing the configuration and status of media and printer-related variables such as those requested by operators. Some combination of the requests can usually be satisfied by a "page device dictionary" reflecting a particular media type contained in at least one of the media trays inserted in printer 10. When no page device dictionary satisfies a setpagedevice request, an appropriate policy or printer driver routine is executed by processor 56 in response to the exceptions found.

The printer driver and PostScript® operators, dictionaries, and policies together govern media selection, media tray selection, and also media tray switching. The following definitions clarify how printer 10 responds to particular setpagedevice operator requests and describes exception cases.

Media selection: Setpagedevice selects one of the media trays as a media source. Exceptions include neither media tray selected, in which case nothing is printed, or a selected media tray having an indeterminate priority. Priority values for all available media sources are stored as an array of integers. The first value in the array represents the highest priority media source, the second value represents the next highest priority media source, and so on. When a setpagedevice request matches both media trays, the media tray with the highest priority value is selected, i.e., the media tray number appearing first in the priority array. If none of the media sources appear in the array, setpagedevice chooses among media trays arbitrarily.

Automatic media tray switching: PostScript® has the capability to cause the printer driver to automatically switch media trays if a selected media tray runs out of media at the start of or during the execution of a print job. Automatic media tray switching is controlled by a /TraySwitch bit stored in the PostScript® currentpagedevice dictionary. Automatic media tray switching occurs only if the /TraySwitch bit in the currentpagedevice dictionary is set true (the default value is preferably true) and the media size and media type in the newly selected media tray is identical to that in the just-emptied media tray.

Selected media tray: At any time, printer 10 has one of media trays 120 or 126 selected which affects two other variables. First, the state of media indicator 134 reflects the status of the medium in the currently selected media tray, and second, paper feeds from the selected media tray when printer 10 starts a print cycle.

Because printer 10 may have zero, one, or two media trays inserted, the printer driver must instruct printer controller 46 which media tray to select before starting a print cycle. The preferred method for selecting a media tray includes the following steps:

Collect entries from currentpagedevice for page size and media type. Other properties not specified by any setpagedevice request are not considered.

Compare the entries collected in step 1 with the media type in each media tray. If a media tray is empty, compare with the media type that was last in the media tray. When printer 10 is first turned on, if a media tray is empty, use a default media type of perf_letter (A-size with a perforated extension).

If only one media tray matches the collected entries, that media tray becomes the currently selected media tray. If both media trays match the collected entries, select the media tray with the highest priority.

If neither tray matches the collected entry, tray selection is arbitrary.

A PostScript®-compatible software routine is available from the assignee of this application for forcing the selection of a specific media tray to thereby select a particular media type loaded in that tray. Skilled workers can write such a routine but must include the following thermal transfer printer-related considerations in their routine:

After forcing a tray selection, any subsequent print job must make an explicit setpagedevice request to select the other media tray.

If the tray selection routine forces selection of a currently empty media tray, no print job will print until the selected media tray is refilled.

Even after executing a forced tray selection routine, PostScript® may allow selection of another tray for the following reasons:

The forced media tray selected has A-size media, the other media tray has A4-size media, and the print job requests A4-size media.

The forced media tray selected has media type PerfPaper, the other media tray has media type PerfTransparency, and the job requests media type PerfTransparency.

(Note: Application software that generates print jobs can usually select media size but not media type.)

PostScript® currently has two revision levels referred to as level-1 and level-2. Tray selection responds differently depending on the revision level. For example, two media trays, one with A-size media and the other with A4-size media are inserted in printer 10. A level-1 operator such as "letter" or "A4" is executed to select the appropriate tray, but the other tray is selected. The reason for the unexpected tray selection is that in level-1 the "letter" and "A4" operators specify printed image size, not media size which influences tray selection. Proper level-1 operators for selecting media size include "lettertray" and "A4tray."

PostScript® level-1 requires two operators to select the media size and image size. For example: statusdict begin A4tray end A4.

PostScript® level-2 uses the single setpagedevice operator to simultaneously specify media size and image size. For example: <</PageSize [612 792]>>setpagedevice.

The foregoing describes how to select media trays, media types, and media sizes and lists known ambiguous or unpredictable results. When a particular media tray is selected, and the media type is supposedly known, the printer driver causes processor 56 to instruct printer controller 46 whether to apply pre-coat to the selected media type.

There are three basic media types on which printer 10 can print: plain paper, coated paper, and transparency film. Ideally, pre-coat is applied only to plain paper. Unfortunately, printer 10 can distinguish only among paper, transparency film, and media size and cannot determine whether the paper is coated. However, printer 10 can always recognize transparency film by sensing the states of microswitches 132, 134, and 146 which are actuated in response to media tray encoding as set forth above in Table 2.

The printer driver resolves the plain or coated paper ambiguity by checking the states of microswitches 132, 134, and 136 and ribbon type sensing microswitches 44 and 45. The printer driver causes application of pre-coat to any type of paper media if the pre-coat ribbon is sensed and paper-type media is sensed but never applies pre-coat if transparency-type media is sensed.

To apply pre-coat only to areas of a print medium where an image will be printed, the printer executes the following steps:

The printer driver specifies to the PostScript® interpreter that the printer is a "CMYK device" (cyan, magenta, yellow, and black).

The printer driver instructs printer controller 46 to simultaneous print cyan, magenta, and yellow when instructed by the PostScript® interpreter to print black.

The printer driver instructs printer controller 46 to print pre-coat when instructed by the PostScript® interpreter to print any combination of cyan, yellow, and magenta.

The printer driver also provides to a post-rendering section of the PostScript® interpreter one of three media type values for selecting an appropriate color-correcting lookup table when printing an image. The three media type values are:

"Coated" if no pre-coat ribbon is sensed and the selected media type is paper,

"Plain" if a pre-coat ribbon is sensed and the selected media type is paper, and "Transparency" if either ribbon type is sensed and the selected media is transparency film.

Skilled workers will understand how to apply the media type values to post-rendering color lookup tables in conjunction with the printer driver whether employing PostScript®, other languages, or custom-coded software.

Alternative embodiments of the present invention can include: implementing the printer driver to interface with any combination of a language other than PostScript®, system-level firmware or software, and hardwired logic; implementations with more than two media trays and/or a manual media feeder; applying pre-coat to monochrome or color printed images; and substituting electro-optical or other sensor technologies for microswitches 44, 45, 132, 134, and 146. Skilled workers will also understand its applicability to a variety of printing technologies including thermal wax transfer and dye diffusion transfer printing.

It will be obvious to those having skill in the art that many changes may be made to the details of the above-described embodiments of this invention without departing from the underlying principles thereof. Accordingly, it will be appreciated that this invention is also applicable to selectable media printing applications other than those found in the field of PostScript®-controlled thermal transfer printing. The scope of the present invention should be determined, therefore, only by the following claims.

We claim:

1. In a thermal transfer printer having first and second media trays, a thermal transfer ribbon, and a processor, an apparatus for selectively applying a pre-coat material to a print medium received from the first media tray in response to a print job request, comprising:

a ribbon sensor communicating to a printer controller that the thermal transfer ribbon includes the pre-coat material;

a first media sensor coupled to the first media tray communicating to the printer controller that the first media tray contains a paper-type print medium; and the processor in data communications with the print job request and the printer controller causes the thermal transfer printer to apply the pre-coat material to the print medium received from the first media tray.

2. The printer of claim 1 in which the thermal transfer ribbon includes panels of different colors to permit printing images on the medium in multiple colors, and in which the processor, in response to a state of the ribbon sensor and a state of the first media sensor, communicates a color correction value to the printer controller for printing a color-corrected color image on the print medium.

3. The apparatus of claim 1 in which the ribbon sensor is a switch that detects a mechanical feature of a spool that holds the thermal transfer ribbon.

4. The apparatus of claim 1 in which the thermal transfer printer is of a wax thermal transfer type.

5. The apparatus of claim 1 in which the processor executes a printer control program that cooperates with a PostScript®-language interpreter.

6. The apparatus of claim 1 in which the first media sensor is a switch that mechanically senses a movable feature of the first media tray.

7. The apparatus of claim 1 in which the print job requests a print medium from the second media tray, and the apparatus further comprises a second media sensor coupled to the second media tray, the second media sensor communicating to the printer controller that the second media tray contains a transparency-type print medium, the processor thereby prevents the thermal transfer printer from applying the pre-coat material to the print medium received from the second media tray.

8. The apparatus of claim 7 further comprising:

a medium detector communicating to the printer controller that the second media tray is empty; and a tray switching means responsive to the medium detector that causes a print medium to be received from the first media tray only if the first and second media sensors are in a same state.

9. A method for determining whether to apply a pre-coat material to a print medium received from one of a first and second media trays in response to a first print job request in a thermal transfer printer having said first and second media trays, a thermal transfer ribbon, and a processor, comprising the steps of:

sensing whether the thermal transfer ribbon includes the pre-coat material;

selecting whether the first media tray contains a paper-type print medium or a transparency-type print medium;

receiving a print medium from the first media tray in response to the first print job request; and applying the pre-coat material to the print medium if the thermal transfer ribbon has the pre-coat material sensed and the first media tray has the paper-type print medium selected.

10. The method of claim 9 in which the thermal transfer printer prints color images, further comprising the steps of:

receiving color image data from the first print job;

modifying the color image data in response to a presence of pre-coat material and a type of print medium selected for the first media tray; and printing a color-corrected image on the print medium received from the first media tray.

11. The method of claim 9 in which the sensing step is accomplished by a switch that detects a mechanical feature of a spool that holds the thermal transfer ribbon.

12. The method of claim 9 in which the thermal transfer printer is of a wax thermal transfer type.

13. The method of claim 9 further including the step of executing in the processor a printer control program that cooperates with a PostScript®-language interpreter.

14. The method of claim 9 in which the selecting step is accomplished by a mechanically sensed media type selector switch that is slidably attached to the first media tray.

15. The method of claim 9 in which the applying step is prevented from applying the pre-coat material to the print medium if the first media tray has a transparency-type print medium selected.

16. The method of claim 9 further comprising the steps of:

selecting whether the second media tray contains a paper-type print medium or a transparency-type print medium;

receiving in response to a second print job a request for a print medium from the first media tray;

detecting that the first media tray is empty; and receiving a print medium from the second media tray if the type of print medium selected in the second media tray matches the type of print medium selected in the first media tray.

* * * * *